US006113103A

United States Patent [19]

Mostashari

[11] Patent Number: 6,113,103

[45] Date of Patent: Sep. 5, 2000

[54] DRAGON POKER

[76] Inventor: Moe Mostashari, 1899 Rancho Hills Dr., Chino Hills, Calif. 91709

[21] Appl. No.: 09/397,318

[22] Filed: Sep. 16, 1999

[51] Int. Cl.[7] ..... A63F 1/00

[52] U.S. Cl. ..... 273/292; 463/13; 463/26

[58] Field of Search ..... 273/236, 292, 273/274; 463/13, 11, 12, 20, 26

[56] References Cited

U.S. PATENT DOCUMENTS

| | | | |
|---|---|---|---|
| 4,948,134 | 8/1990 | Suttle et al. | 273/85 CP |
| 5,022,653 | 6/1991 | Suttle et al. | 273/85 CP |
| 5,511,781 | 4/1996 | Wood et al. | 273/85 CP |
| 5,560,613 | 10/1996 | Nguyen | 273/292 |
| 5,607,162 | 3/1997 | Boylan et al. | 273/292 |
| 5,725,216 | 3/1998 | Jones | 273/292 |
| 5,810,663 | 9/1998 | Bochichio et al. | 463/13 |
| 5,820,460 | 10/1998 | Fulton | 463/13 |
| 6,007,424 | 12/1999 | Evers et al. | 463/13 |

*Primary Examiner*—Sebastiano Passaniti
*Assistant Examiner*—Dolores R. Collins
*Attorney, Agent, or Firm*—Leonard Weiss

[57] ABSTRACT

In a variation of Pai Gow Poker known as Dragon Poker, a player posts a wager and is dealt a first four of seven cards face down. A bank is dealt a first a first four of seven cards, three of which are dealt face up. The player is then given an option of surrendering and receiving a return of a portion of the wager. With the surrender, the player's participation in the game is at an end. The player who does not surrender is a surviving player who may be given an option of increasing the wager. The surviving player and the bank are each dealt three additional cards to enable formation of a player back hand and a player front hand and formation of a bank back hand and a bank front hand. After the hands are formed, the wager is resolved.

3 Claims, 1 Drawing Sheet

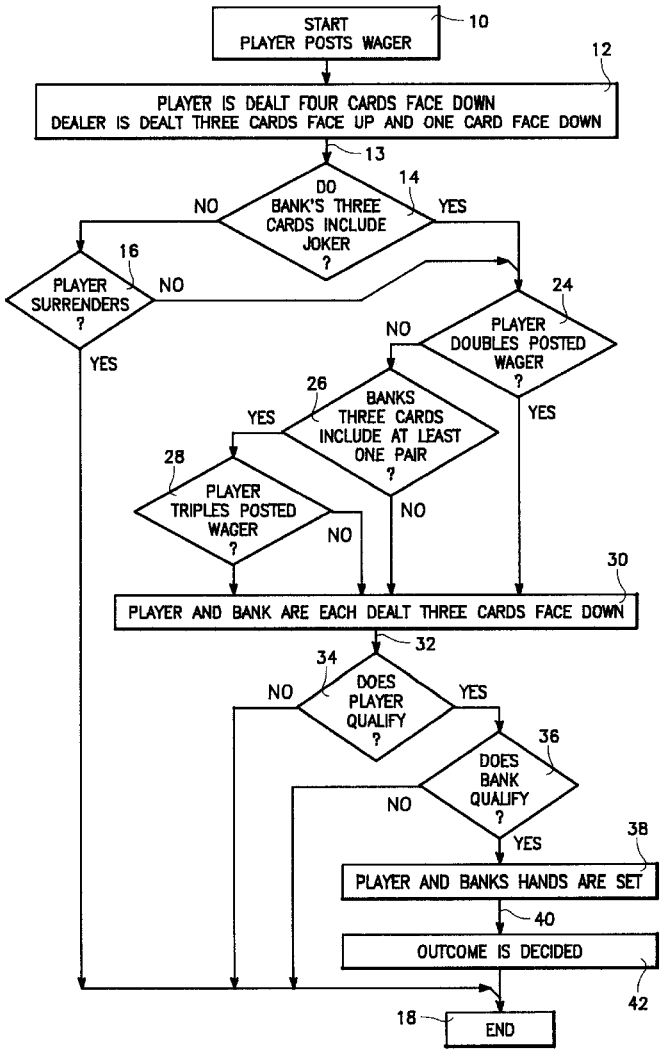

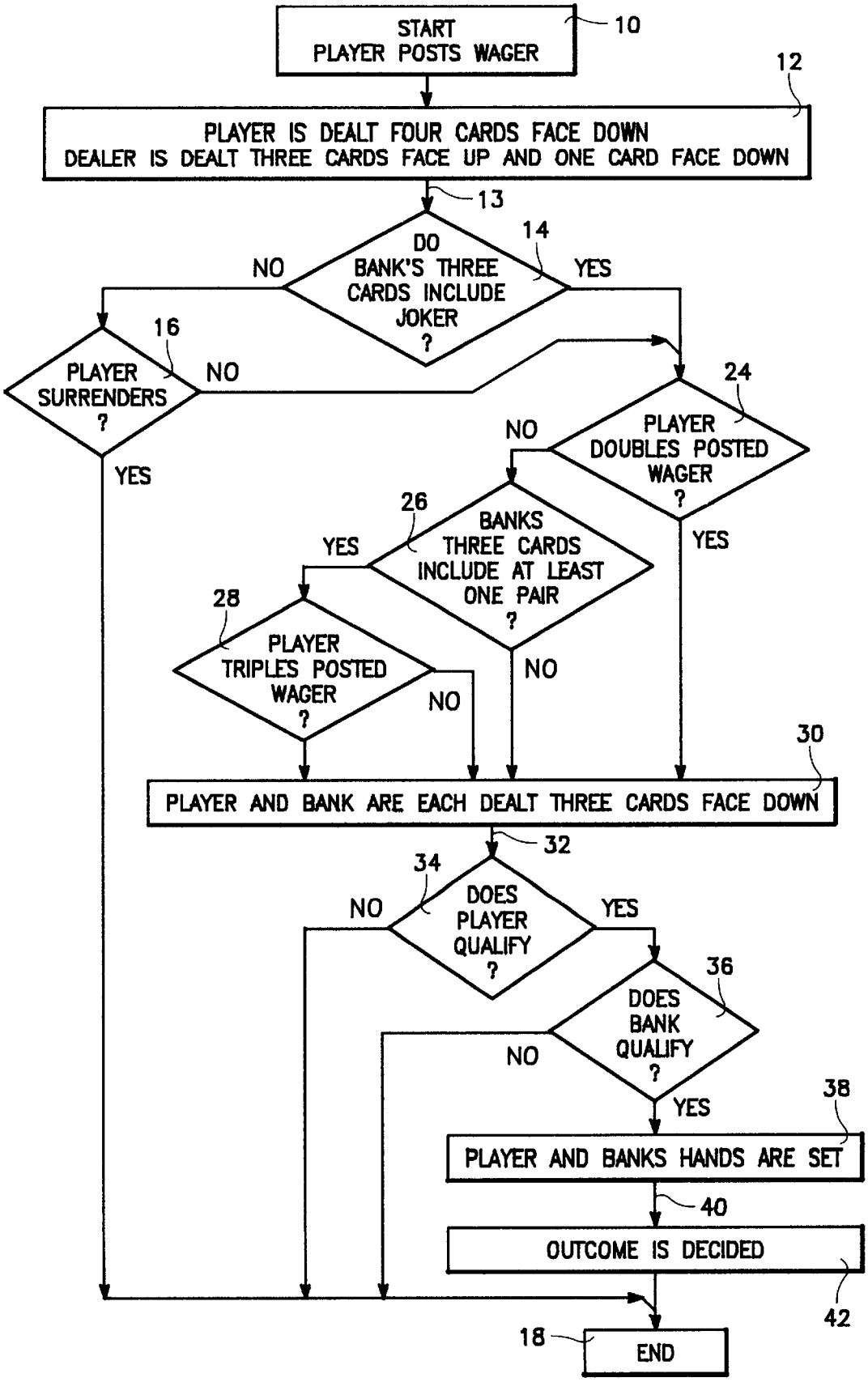
START
PLAYER POSTS WAGER
10
12
PLAYER IS DEALT FOUR CARDS FACE DOWN
DEALER IS DEALT THREE CARDS FACE UP AND ONE CARD FACE DOWN
13
14
DO BANK'S THREE CARDS INCLUDE JOKER ?
NO
YES
16
PLAYER SURRENDERS ?
NO
YES
24
PLAYER DOUBLES POSTED WAGER ?
NO
YES
26
BANKS THREE CARDS INCLUDE AT LEAST ONE PAIR ?
YES
NO
28
PLAYER TRIPLES POSTED WAGER ?
NO
30
PLAYER AND BANK ARE EACH DEALT THREE CARDS FACE DOWN
32
34
DOES PLAYER QUALIFY ?
NO
YES
36
DOES BANK QUALIFY ?
NO
YES
38
PLAYER AND BANKS HANDS ARE SET
40
OUTCOME IS DECIDED
42
18
END

DRAGON POKER

BACKGROUND OF THE INVENTION

1. Field of Invention

This invention is in the general field of casino gaming and, more particularly, is a variation of Pai Gow Poker.

2. Description of the Prior Art

Pai Gow Poker (referred to hereinafter as Pai Gow) is a variation of poker that is based upon a Chinese domino game. Pai Gow is played with a standard deck of fifty two cards augmented by a joker. The joker is a wild card which can be used either as an ace or to complete a straight, a flush or a straight flush. Pai Gow is played by a dealer and as many as six players. The dealer is referred to as a bank. Each of the players compete against the bank.

In a formal Pai Gow game, there is an elaborate procedure that includes a throw of three dice to decide which one of seven players is to be designated as the bank. Unlike the formal Pai Gow game, in a casino, the bank is an employee of the casino.

Prior to play, each player posts a wager. Thereafter, seven cards are dealt face down to each player and to the bank.

The players divide their seven cards to form a five card player hand and a two card player hand that are referred to as a back hand and a front hand, respectively. The rank of a back hand is the same as in poker, with five aces having a higher rank than a royal flush. In the front hand, any pair has a higher rank than any two unmatched cards, but no other combinations are possible.

A player's back hand must outrank the player's front hand. Thus, the player's front hand can be a pair of aces only when the player's back hand includes a minimum of two pairs.

After the players' hands are formed, they are placed face down and the bank's seven cards are exposed. The bank divides the seven exposed cards to form a bank back hand and a bank front hand in a manner similar to the forming of the players' hands.

After the bank's hands are formed, the players' hands are turned face up, thereby exposing the players' hands. The bank's back hand is compared to the back hand of each of the players. Correspondingly, the bank's front hand is compared to the front hand of each of the players. A winner is determined in accordance with the following rules:

1. When both of a player's hands outrank both of the bank's hands, the player wins. The bank pays out an amount equal to the player's posted wager.

2. When one of the bank's hands outranks one of the player's hands and the other of the bank's hands is outranked by the player's hand, there is what is referred to as a push; no money changes hands.

3. When both of the bank's hands outrank both of the player's hands, the bank wins. The dealer takes the player's posted wager.

4. When the bank and the player have one hand of equal rank and the other of the bank's hands outranks the other of the player's hands, the bank wins. The bank takes the player's posted wager.

5. When the bank's back and front hands are respectively equal in rank to the player's back and front hands, the bank wins. The bank takes the player's posted wager.

One undesirable aspect of Pai Gow is that approximately 40% of play results in a push. Additionally, players are not rewarded for being able to form hands of unusually high rank.

SUMMARY OF THE INVENTION

An object of the present invention is a variation of Pai Gow Poker that reduces the number of pushes.

Another object of the invention is to provide a player with a bonus payout when the player holds cards of a rank that equals a selected rank.

According to the present invention, after a player posts a wager, a first four of seven cards are dealt to the player and a first four of seven cards are dealt to a bank. The player's four cards are dealt face down. A known number of the bank's four cards are dealt face up. The player is then given an option of surrendering and receiving a return of a portion of the wager. With the surrender, the player's participation in the game is at an end. The player who does not surrender is a surviving player who may be given an option of increasing the wager. The surviving player and the bank are each dealt three additional cards to enable formation of a player back hand and a player front hand and formation of a bank back hand and a bank front hand. After the hands are formed, the wager is resolved.

Other objects, features, and advantages of the invention should be apparent from the following description of the preferred embodiment thereof as illustrated in the accompanying drawing.

BRIEF DESCRIPTION OF THE DRAWING

The sole FIGURE herein is a logic flow diagram of major aspects of the preferred embodiment.

DESCRIPTION OF THE PREFERRED EMBODIMENT

Dragon Poker is a variation of a game known as Pai Gow Poker that is played with a standard deck of playing cards augmented by a joker. As shown in the drawing, an action element 10 represents a player posting a wager at the start of Dragon Poker. It should be understood that the player is exemplary of each of a plurality of players who may be playing the game The element 10 is followed by an action element 12 that carries lettering therein of the words:

PLAYER IS DEALT FOUR CARDS FACE DOWN BANK IS DEALT THREE CARDS FACE UP AND ONE CARD FACE DOWN

In accordance with the element 12, a first four of seven cards of a player's hand and a first four of seven cards of a bank's hand are dealt. The player's four cards are dealt face down. Three of the bank's four cards are dealt face up, the remaining bank card being dealt face down.

The element 12 is connected through a path 13 to a decision element 14 that carries lettering therein of the words:

DO BANK'S THREE CARDS INCLUDE JOKER?

The element 14 is connected to a decision element 16 through a path marked with lettering of the word, NO, thereby indicating a valid path when the bank's three face up cards do not include the joker. The element 16 carries lettering therein of the words:

PLAYER SURRENDERS?

In other words, when the bank's three face up cards do not include the joker, the player has an option of surrendering after viewing the player's four cards and the bank's three face up cards.

The element 16 is connected to an action element 18 through a path marked with lettering of the word, YES, thereby indicating a valid path when the player exercises the surrender option. The element 18 carries therein lettering of the word, END, thereby indicating that the player's participation in the game ends when the surrender option is exercised.

By exercising the surrender option, the player loses one half of the posted wager. When the surrender option is not exercised, the player is more precisely referred to as a surviving player.

The element 14 is connected to a decision element 24 through a path marked with lettering of the word, YES, thereby indicating a valid path when the bank's three face up cards include the joker. Additionally, the element 16 is connected to the element 24 through a path marked with lettering of the word, NO, thereby indicating a valid path when the surrender option is not exercised. The element 24 carries therein lettering of the words:

DOES PLAYER DOUBLE POSTED WAGER?

In accordance with the element 24, the surviving player has an option of doubling the posted wager.

The element 24 is connected to a decision element 26 through a path marked with lettering of the word, NO, thereby indicating a valid path when the surviving player elects not to exercise the option of doubling the posted wager. The element 26 carries therein lettering of the words:

BANK'S THREE CARDS INCLUDE AT LEAST A PAIR?

The element 26 is connected to a decision element 28 through a path marked with lettering of the word, YES, thereby indicating a valid path when the bank's three face up cards include either a pair or three of a kind.

The element 28 carries therein lettering of the words:

DOES PLAYER TRIPLE POSTED WAGER?

Therefore, when the surviving player has declined to double the posted wager and the bank's three face up cards include at least a pair, the surviving player has an option of tripling the posted wager.

The bank and the surviving player each receive three additional cards face down when either:

1. the surviving player exercises the option of doubling the posted wager which is represented through a path marked with lettering of the word, YES, that connects the element 24 to an action element 30 that carries therein lettering of the words:

PLAYER AND BANK ARE EACH DEALT THREE CARDS FACE DOWN 2. the surviving player decides not to exercise the option of doubling the posted wager and the bank's three face up cards do not include at least a pair which is represented by a path marked with lettering of the word, NO, that connects the element 26 to the element 30; or 3. the surviving player decides to either exercise or not to exercise the option of tripling the posted wager which is represented by a path marked with lettering of the word, NO, and a path marked with lettering of the word YES; both paths connect the element 28 to the element 30.

Since the surviving player and the bank are each dealt a final three cards face down, the surviving player holds seven face down cards and the bank holds four face down cards and three face up cards.

Preferably, after the bank and the surviving player are dealt their final three cards, the surviving player must either qualify or lose the wager. An example of a player qualification requirement is that the surviving player's seven card holding must include at least a king whereby the surviving player becomes a qualified player.

To provide a representation of the player qualification requirement, the element 30 is connected through a path 32 to a decision element 34 that carries therein lettering of the words:

DOES PLAYER QUALIFY?

The element 34 is connected to the element 18 through a path marked with lettering of the word, NO, thereby indicating a valid path when the surviving player is unqualified. Participation in the game ends for the unqualified surviving player. Additionally, the wager of the unqualified surviving player is lost.

Preferably, the bank must either qualify or make a payout on the wagers of the qualified player. Similar to the player qualification requirement, an example of a bank qualification requirement is that the bank's seven card holding must include at least a king.

To provide a representation of the bank qualification requirement, the element 34 is connected to a decision element 36 through a path marked with lettering of the word, YES, thereby indicating a valid path when the bank qualifies. The element 36 carries lettering therein of the words:

DOES BANK QUALIFY?

The element 36 is connected to the element 18 through a path marked with lettering of the word, NO, thereby indicating a valid path when the bank is unqualified. Hence, when the bank is unqualified, the bank makes payouts as described hereinbefore and the game is at an end.

The element 36 is connected to an action element 38 through a path marked with lettering of the word, YES, thereby indicating a valid path when the bank qualifies. The element 38 carries therein lettering of the words:

PLAYER AND BANK'S HANDS ARE SET

In accordance with the element 38, the qualified player forms back and front hands. Thereafter, the bank's four face down cards are turned face up and the bank's back and front hands are formed.

The element 38 is connected through a path 40 to an action element 42 that carries therein lettering of the words:

OUTCOME DECIDED

In accordance with the element 40 the qualified player's hands are compared to the qualified bank's hands to decide the winner of the wager in a manner similar to the comparison of the prior art.

As in the prior art, when the joker is included in the bank's three face up cards or in any of the surviving player's cards, it can be used as an ace or to complete a straight, a flush or a straight flush. However, when the joker is included in any other of the bank's cards, it is a wild card of any desired value. Preferably, there is a bonus payout to a qualified surviving player in accordance with a schedule given as:

QUALIFIED SURVIVING PLAYER'S BACK HAND PAYOUT

| QUALIFIED SURVIVING PLAYER'S BACK HAND | PAYOUT |
|---|---|
| three of a kind | 3 to 2 |
| straight, flush or full house | 2 to 1 |
| four of a kind or straight flush | 3 to 1 |
| five of a kind | 4 to 1 |
| natural royal flush | 5 to 1 |

While the invention has been particularly shown and described with reference to a preferred embodiment thereof, it should be understood by those skilled in the art that changes in form and detail may be made therein without departing from the spirit and scope of the invention.

I claim:

1. In the method of playing an improved game of Pai Gow Poker where a bank and a player are dealt cards from a standard deck of cards augmented by a joker, the cards being dealt after the player posts a wager, the improvement comprising the steps of:

dealing four cards to the player and four cards to the bank, the player's four cards being dealt face down and a known number of the bank's cards being dealt face up:

giving the player an option of surrendering after the player's and bank's four cards are dealt, the player's participation in the game ending and the player losing a portion of the wager when the surrender option is exercised, the player becoming a surviving player by not exercising the surrender option;

dealing three cards face down to the surviving player and to the bank, whereby the surviving player and the bank each have seven cards;

determining whether the surviving player's seven cards have a rank that is greater or equal to a player qualification rank, whereby the surviving player is qualified;

the surviving player losing the wager by not being qualified;

forming a bank back hand and a bank front hand by the bank from the bank's seven cards;

forming a player back hand and a player front hand by the qualified player from the qualified player's seven cards; and comparing the bank's back and front hands to the qualified player's back and front hands, respectively, to determine a winner of the wager.

2. In the method of playing the game of claim 1 wherein the bank becomes qualified when the bank's seven cards have a rank that is greater or equal to a bank qualification rank, including the additional step of the bank losing the wager by not being qualified when the surviving player is qualified.

3. In the method of playing an improved game of Pai Gow Poker where a bank and a player are dealt cards from a standard deck of cards augmented by a joker, the cards being dealt after the player posts a wager, the improvement comprising the steps of:

dealing four cards to the player and four cards to the bank, the player's four cards being dealt face down and a three of the bank's cards being dealt face up:

giving the player an option of surrendering after the player's and bank's four cards are dealt when the bank's three face up cards do not include the joker, the player's participation in the game ending and the player losing a portion of the wager when the surrender option is exercised, tne player becoming a surviving player by not exercising the surrender option;

dealing three cards face down to the surviving player and to the bank, whereby the surviving player and the bank each have seven cards;

forming a bank back hand and a bank front hand by the bank from the bank's seven cards;

forming a player back hand and a player front hand by the surviving player from the surviving player's seven cards;

comparing the bank's back and front hands to the surviving player's back and front hands, respectively, to determine a winner of the wager, the joker being usable as an ace or to complete a straight, a flush or a straight flush when included in either the bank's three face up cards or in any of the surviving player's cards and as a wild card of any desired value when included in any other of the bank's cards.

* * * * *